US007267346B2

(12) United States Patent
Zejdlik et al.

(10) Patent No.: US 7,267,346 B2
(45) Date of Patent: Sep. 11, 2007

(54) SNOWBOARD ACCESSORY

(76) Inventors: Donald A. Zejdlik, 941 5th Ave. SE., East Grand Forks, MN (US) 56721; Adam S. Zejdlik, 941 5th Ave. SE., East Grand Forks, MN (US) 56721

( * ) Notice: Subject to any disclaimer, the term of this patent is extended or adjusted under 35 U.S.C. 154(b) by 0 days.

(21) Appl. No.: 11/043,744

(22) Filed: Jan. 26, 2005

(65) Prior Publication Data

US 2005/0161907 A1 Jul. 28, 2005

Related U.S. Application Data

(60) Provisional application No. 60/539,817, filed on Jan. 28, 2004.

(51) Int. Cl.
*B62B 13/00* (2006.01)
*A63C 9/00* (2006.01)

(52) U.S. Cl. ..... 280/14.22; 280/618; 280/616

(58) Field of Classification Search ..... 280/616, 280/617, 618, 607, 613, 14.2, 14.22, 14.21, 280/14.23

See application file for complete search history.

(56) References Cited

U.S. PATENT DOCUMENTS 4,652,007 A * 3/1987 Dennis ..... 280/618
4,741,550 A * 5/1988 Dennis ..... 280/618
5,054,807 A * 10/1991 Fauvet ..... 280/607
5,094,470 A * 3/1992 Riedel ..... 280/607
5,884,933 A * 3/1999 Trott ..... 280/603
6,209,904 B1 * 4/2001 Schnitzhofer ..... 280/616
6,257,614 B1 * 7/2001 Duggan ..... 280/618
6,279,924 B1 * 8/2001 Murphy et al. ..... 280/14.23
6,808,183 B2 * 10/2004 Schaller et al. ..... 280/14.22
6,817,619 B2 * 11/2004 Harrison ..... 280/14.22
6,848,703 B2 * 2/2005 Godde et al. ..... 280/607
6,923,464 B2 * 8/2005 Noviant ..... 280/607
2003/0116931 A1 * 6/2003 Quattro et al. ..... 280/14.21
2005/0285373 A1 * 12/2005 Miller et al. ..... 280/623

FOREIGN PATENT DOCUMENTS

EP 335463 A2 * 10/1989
FR 2628000 A1 * 9/1989
FR 2652753 A1 * 4/1991

* cited by examiner

*Primary Examiner*—Hau Phan
(74) *Attorney, Agent, or Firm*—Robert E. Kleve

(57) ABSTRACT

The invention comprises a snowboard having an elongated plastic plank as its body with up curved remote ends. A pair of circular plates are fixed to the top of the plank spaced toward the opposite end of the plank to serve as base for mounting bindings thereon and to raise the bottoms of the bindings a narrow distance or height above the plank. A metal elongated steel bar is fixed along the length of the plank along top of the plank to give the plank added strength and rigidity for additional control of the plank by the operator of the plank.

4 Claims, 2 Drawing Sheets

SNOWBOARD ACCESSORY

This invention relates to snowboards and the like. This invention also relates to our provisional U.S. Patent Application, filed Jan. 28, 2004, Ser. No. 60/539,817, the priority of which is claimed in this application.

It is an object of the invention to provide a novel snowboard which reduces the flexibility of the snowboard to provide greater control of the snowboard by the operator of the board, as it has found that reducing the flex of a snowboard requires less effort to perform the same or similar tricks with the board.

It is a further object of the invention to provide a novel snowboard having a center bar of relative strength to extend centrally along the length of the board to reduce its flexibility.

It is a further object of the invention to provide a novel snowboard of increased strength and which has improved boot location and support on the snowboard.

In the past, snowboards have been commonly made with great flexiblity; however, this flexibility, it has been found, increases the contact of the board with multiple surfaces resulting in poor control for doing spins, turns, and other trick maneuvers with the board.

It is an object of the invention to provide a center bar of great strength such as steel to give the the board greater strength without significantly increasing the weight of the board as might occur if the entire board were made of a heavy metal such as steel. As a result of the narrow metal bar sufficient additional strength is provided to the board with the rest of the board made of relatively light material such as molded plastic so as to maintain the relatively light weight of the board for easier movement of the board with the operator's feet and holding of the board with the feet of the operator of the board when snowboarding with the snowboard.

Further objects and advantages of the invention will become apparent as the description proceeds and when taken in conjunction with the accompanying drawings wherein

BRIEF DESCRIPTION OF PREFERRED EMBODIMENT

Briefly stated the invention comprises a snowboard accessory invention which may be attached to conventional snowboards particularly those snowboards of a three hole or four hole bindings bolt attachment variety. The snowboard accessory has a pair of circular plates to be mounted to the snowboard at the location where the bindings for operating the board are attached. The plates serve as spacers to elevate the bindings higher on the board, and the spacers also have slots to retain the rigidity bar flush to the board to increase the rigidity of the snowboard.

Figure 1:
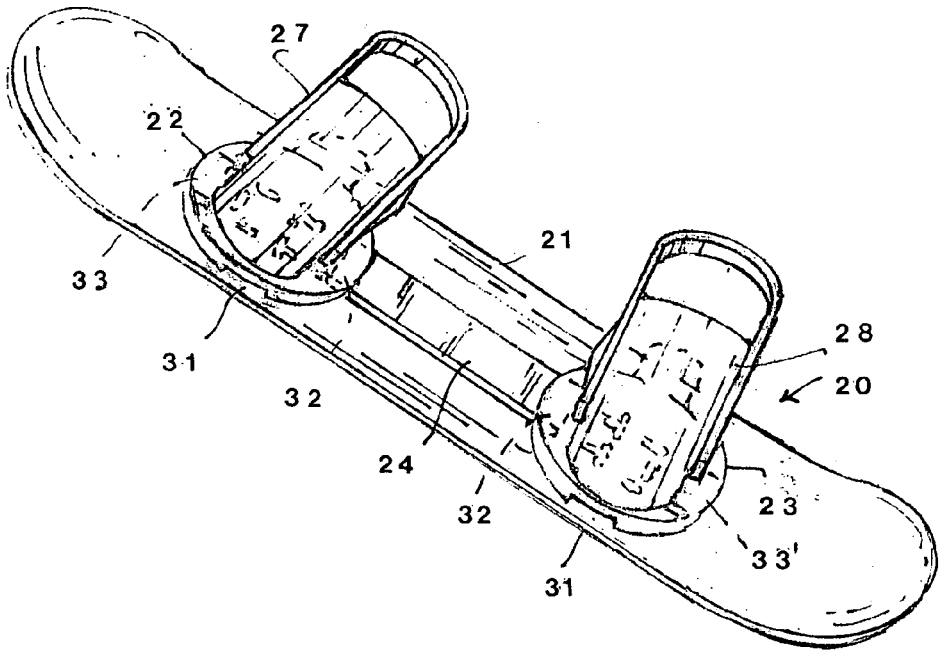
FIG. 1 is a perspective view of the snowboard invention.
Figure 2:
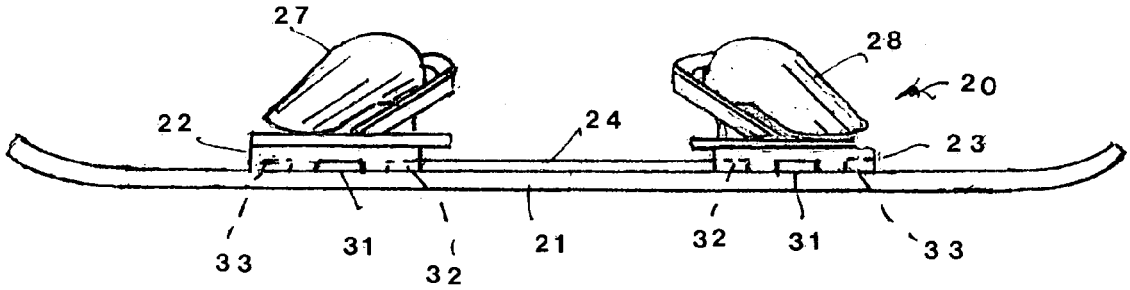
FIG. 2 is a side elevational view of the snowboard invention.
Figure 3:
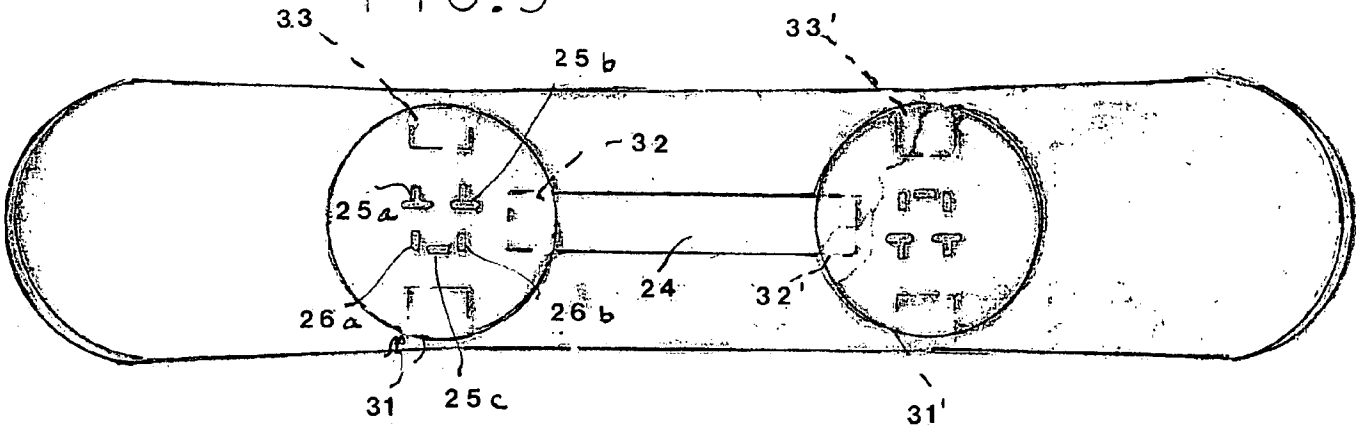
FIG. 3 is a top view of the snowboard invention.
Figure 4:
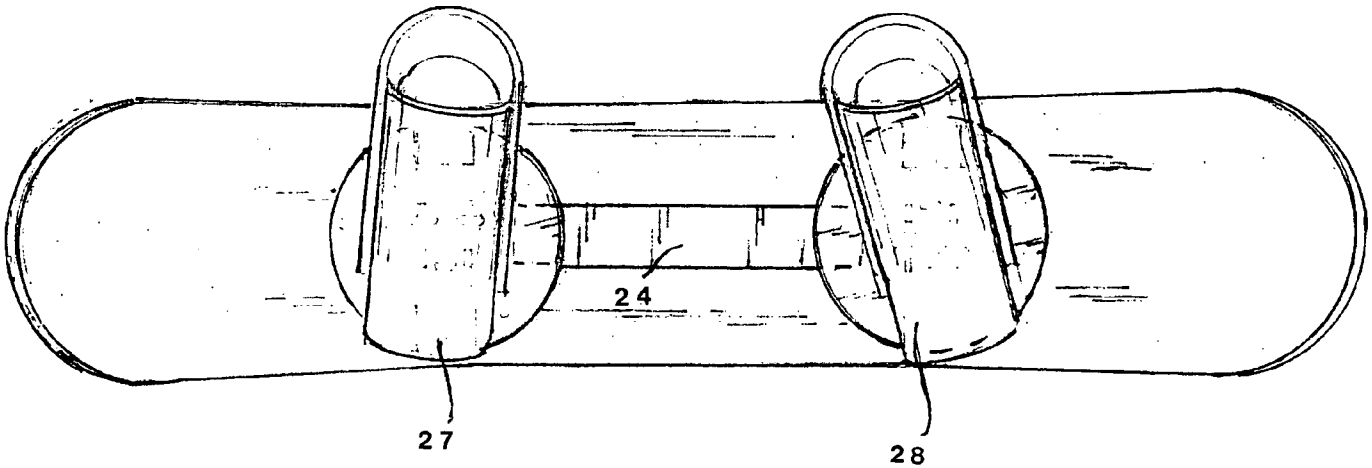
FIG. 4 is a top view of the snowboard invention with the bindings for the board removed and the supporting plates for the bindings shown with a portion of one of the plates cutaway.

Referring more particularly to the drawings, in FIG. 1, the snowboard accessory invention 20 is shown attached to a conventional snowboard 21. The snowboard accessory invention has a pair circular plates 22 and 23 and a rigidity bar 24. The two circular plates each have a series of five holes; 25*a*, 25*b*, 25*c* and 26*a*,26*b*. The three holes 25*a*, 25*b*, and 25*c* form the three holes for the snowboards having a three hole mounting construction for mounting of the snowboard operator on these types of snowboards, and the four holes 25*a*, 25*b*, 26*a*, 26*b* form the four holes for mounting binding on snowboards having a four hole mounting construction.

When mounting the snowboard accessory invention 20 to a conventional snowboard 21 having a four hole construction, the plates 22 and 23 will placed at their spaced locations on the snowboard for mounting conventional bindings 27 and 28 to a conventional snowboard to align the holes in the plates to the pair of conventional four threaded holes in the snowboard. Then the rigidity bar 24 will be placed on the snowboard 21 with the ends of the bar 24 inserted in the slots 30 and 30' in the plates 22 and 23.

Thereupon, four bolts 29 will be inserted through holes in the base 31 of each bindings and through the four holes 25*a*, 25*b*, 26*a*, and 26*b* in each circular plate 22 and 23 and threaded into each of the pair of four holes in the conventional snowboard to lock the bindings, plates, and rigidity bar 24 to the snowboard 21.

The circular plates 22 and 23 on the snowboard act to space the bindings upward further from the snowboard. Traditionally, the bindings are mounted directly to the snowboard. The spacing of the bindings upward from the top edge surface of the snowboard, provides the advantage that the toe of the snowboots, when mounted in the bindings, will not dig into the snow as easily when the operator angles or tilts his feet on the snowboard to tilt board lengthwise on its edge toward his toes at an angle to the snow on the ground as he snowboards along the snow and attempts to turn or perform other angular maneuvers.

Consequently, it is easier for the snowboarders on the snowboard, as there is less likelihood of interference with the snow by his toes engaging the snow.

The circular plates each have three slots 30, 31, and 32, and 30', 31', and 32' so that plates can be aligned to match the holes in a snowboard having either a four hole construction or four hole construction.

The circular plates may be made of a one piece molded plastic preferrably, Athough, if desired they may be made of a molded metal construction.

When the bindings have been locked to the snowboard with the plates therebetween, the plates act to lock the rigidity bar flush with the snowboard as illustrated in the drawings. This locking of the steel bar to flush to the surface of the snowboard centrally along it length act to make the board more rigid as the board will not flex as easily.

Providing a steel bar locked flush with the board along its length provides a center bar of great strength such as steel which in turn gives the board greater strength without significantly increasing the weight of the board as might occur if the entire board were made of a heavy metal such as steel.

As a result of the narrow metal bar sufficient additional strength is provided to the board while the rest of the board may be made of relatively light material such as molded plastic, so as to maintain the relatively light weight of the board for easier movement of the board with the operator's feet and holding of the board with the feet of the operator of the board when snowboarding with the snowboard.

In the past, snowboards have been commonly made with great flexiblity; however, this flexibility, it has been found, increases the contact of the board with multiple surfaces resulting in poor control for doing spins, turns, and other trick maneuvers with the board. The rigid steel bar makes the board more rigid making it easier to turn, angle, and otherwise maneuver the board while snowboarding.

Thus it will be seen that a novel snowboard accessory invention which can be easily mounted to conventional snowboard and provides more rigidity and serve as a flex reduction bar to the snowboard and better placement of the bindings on the snow board for improved snowboarding performances by the operator of the snowboard.

Further, it has been found that the plates and bar may be easily mounted to a conventional snowboard as an accessory to the snowboard, without the necessity of altering the snowboard.

It will be obvious that various changes and departures may be made to the invention without departing from the spirit and scope thereof, and accordingly, it is not intended that the invention be limited to that specifically described in the specification, or as illustrated in the drawings, but only as set forth in the appended claims, wherein

What is claimed is:

1. A snowboard accessory for an elongated snowboard of customary length and width and having upturned remote ends, said accessory comprising a pair of circular plastic disc members adapted to be mounted to the snow board in spaced relation along the length of the board toward the remote ends of the board, said plastic disc members serving to receive foot bindings thereon of an operator to place his feet when operating the snow board with the bindings fixed on the board above the circular plastic disc members, said disc members having recessed slots confronting one another, an elongated metal bar narrow in relation to the width of the board and positioned centrally of the width of the board and extending in length along the length of the board between the circular plastic disc members, said bar having remote ends received in the confronting slots, said plastic disc members also having means to secure the discs and remote ends of the metal bar rigidly to the board in the slots in close complementary relation.

2. A snowboard accessory according to claim 1 wherein said elongated metal bar is of relatively greater strength than the board and fixed along the length of the board between the spaced binding support members and disks to provide rigidity to the snowboard.

3. A snowboard accessory for an elongated snowboard of customary length and width and having upturned remote ends, said accessory comprising a pair of disc members adapted to be mounted to the snow board in spaced relation along the length of the board toward the remote ends of the board, said disc members serving to receive bindings for placement of the bindings on the board above the disc members, said disc members each having a slot confronting one another and recessed into said disc member, an elongated metal bar narrow in relation to the width of the board and positioned centrally of the width of the board and extending in length along the length of the board between the disc members with the remote ends of the bar received in the confronting slots of the disc members, said disc members also having means to secure the discs and metal bar rigidly to the board with the bar in the slots in close complementary relation.

4. A snowboard accessory for attachment to an elongated snowboard of customary length and customary width having three hole mounting or a snowboard having four hole mounting with the bolts projecting upward from the snowboard to receive the bindings for the snowshoes, said accessory comprising pair of spaced circular disks, an elongated brace having remote ends, said discs each having three holes positioned on the disks for receiving the bolts of a three hole snowboard, said disks also having four holes which when the disks are rotated 90 degrees and replaced on the snowboard will receive the bolts of the snowboard having four projecting bolts, said pair of disks also having three recessed slots in their outer edge at 90 degree intervals about each disc to one another so that whether the discs are placed in alignment having for a snowboard having three bolts or four bolts, one pair of the three slots may face towards and confront one another so as to enable the brace to have its remote ends be received in one of the pair of confronting slots, said elongated brace having a width relatively narrow to the width of the board and mounted centrally to the width of the board, said elongated brace acting to give greater strength to the board when the bindings are bound onto the board on either the three hole snowboard or four hole snowboard, said discs having means to secure the discs rigidly to the snow board with the discs rigidly securing the ends of the brace to the snowboard, said disks serving as raised support members on the board for supporting the bindings thereon at a level spaced above the top level of the board.

* * * * *